US012228011B2

(12) United States Patent
Gaspard

(10) Patent No.: US 12,228,011 B2
(45) Date of Patent: Feb. 18, 2025

(54) CONVERTIBLE VALVE FOR USE IN A SUBTERRANEAN WELL

(71) Applicant: Weatherford Technology Holdings, LLC, Houston, TX (US)

(72) Inventor: Gregory Gaspard, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 0 days.

(21) Appl. No.: 18/335,010

(22) Filed: Jun. 14, 2023

(65) Prior Publication Data

US 2024/0410251 A1 Dec. 12, 2024

Related U.S. Application Data

(60) Provisional application No. 63/507,295, filed on Jun. 9, 2023.

(51) Int. Cl.
*E21B 34/10* (2006.01)

(52) U.S. Cl.
CPC ..... *E21B 34/102* (2013.01)

(58) Field of Classification Search
CPC ..... E21B 34/102
See application file for complete search history.

(56) References Cited

U.S. PATENT DOCUMENTS 3,409,078 A * 11/1968 Knox ..... E21B 21/10 166/374
4,683,955 A 8/1987 Stepp et al.
4,738,282 A 4/1988 Boehringer et al.
5,209,253 A * 5/1993 Taylor ..... F16K 17/164 137/461
5,411,049 A 5/1995 Colvard
6,279,552 B1 * 8/2001 Okada ..... F16K 1/443 123/568.29
6,622,795 B2 9/2003 Hebert
8,955,543 B2 2/2015 Groesbeck et al.
9,085,967 B2 7/2015 Bennett
9,206,674 B2 12/2015 Luke
10,435,984 B2 10/2019 Mericas
11,242,719 B2 2/2022 Montoya
2004/0112644 A1 * 6/2004 Chan ..... E21B 23/004 175/57
2006/0278286 A1 12/2006 Spakowski
2010/0300566 A1 * 12/2010 Roberts ..... F16K 17/0473 137/614.05
2013/0233548 A1 9/2013 Santeler
2017/0167225 A1 * 6/2017 Mericas ..... E21B 23/006
2020/0040702 A1 2/2020 Stone
2021/0222516 A1 * 7/2021 Montoya ..... E21B 25/00

OTHER PUBLICATIONS

Large Bore Auto-Fill II Float Collar, Weatherford, Cementing Products, 2008, 5 pages.

* cited by examiner

*Primary Examiner* — Taras P Bemko
(74) *Attorney, Agent, or Firm* — Peter V. Schroeder; Booth Albanesi Schroeder PLLC

(57) ABSTRACT

A convertible valve assembly has an upper and lower plunger valve connected to one another so that they reciprocate together. A retainer assembly holds the valves in a bi-directional configuration, allowing fluid flow in both directions through the valves. The retainer assembly then releases the valves to a unidirectional configuration upon application of a downhole hydraulic pressure, so that fluid can flow only one direction through the valve assembly.

20 Claims, 5 Drawing Sheets

CONVERTIBLE VALVE FOR USE IN A SUBTERRANEAN WELL

CROSS-REFERENCE TO RELATED APPLICATIONS

None.

TECHNICAL FIELD

This disclosure relates generally to oilfield downhole valves tools, and more particularly to methods and apparatus for converting a valve assembly from bi-directional to unidirectional when in a wellbore.

BRIEF DESCRIPTION OF THE DRAWINGS

Drawings of the preferred embodiments of the present disclosure are attached hereto so that the embodiments of the present disclosure may be better and more fully understood.

DETAILED DESCRIPTION OF EMBODIMENTS

After a wellbore is drilled through a formation, it is typical to line the wellbore with a tubular, such as a casing. To prevent the casing from moving within the wellbore, the casing annulus is filled with cement during a cementing operation. As the casing is run in it is typically filled with a fluid, such as drilling mud. It is common to place a float assembly, such as a float shoe or float collar, at or near the bottom of the casing string. The float assembly has one or more unidirectional float valves which allow fluid to pass from the casing string into the annulus but prevent flow from the annulus back into the casing string. These float valves can serve two purposes.

While running the casing string into the wellbore, it is common to use the wellbore fluid to sustain a portion of the weight of the casing string by floating the casing string in the wellbore fluid. The float assembly prevents fluid flow into the bottom of the string, allowing the string to float in the fluid present in the wellbore. Once in position in the wellbore, the float valves allow the flow of fluids during, for example, a cementing operation, such as spacer fluid, cement, displacement fluid and the like, as they are pumped down the casing string, through the unidirectional float valves and into the wellbore annulus. The float valves keep these fluids from flowing from the annulus back into the casing string.

However, in some instances it is preferable to insert the casing string without floating the string. In such a case, the unidirectional float valves are a hinderance to running in the string. Instead, a bidirectional valve is needed, allowing fluid flow up the string during run in. A convertible valve acts as a bidirectional valve during run in, and then converts to a unidirectional valve, like a typical float valve, once positioned downhole. This allows fluid flow upwards during run in but prevents flow back into the string during later pumping operations. Convertible valves, or auto-fill valves, are known in the industry and typically rely on a flapper valve which is maintained in an open position during run in, allowing automatic filling of the casing string. The valve is converted to a unidirectional valve, by releasing the flapper from the open position, with the flapper then biased towards the closed position.

The terms "above" and "below, and "behind" and "in front," are used herein without respect to whether the wellbore is vertical or horizontal. Similarly, the terms "uphole," "downhole," and the like are used without respect to whether the wellbore is vertical or horizontal. For example, a fluid, tool or the like, said to be above, behind, or uphole of another tool is relatively closer to the wellhead, or having entered the wellbore later, whether along a horizontal or vertical portion of the wellbore. As persons of skill in the art will understand, the disclosures herein are applicable in horizontal and vertical wells.

Figure 1:
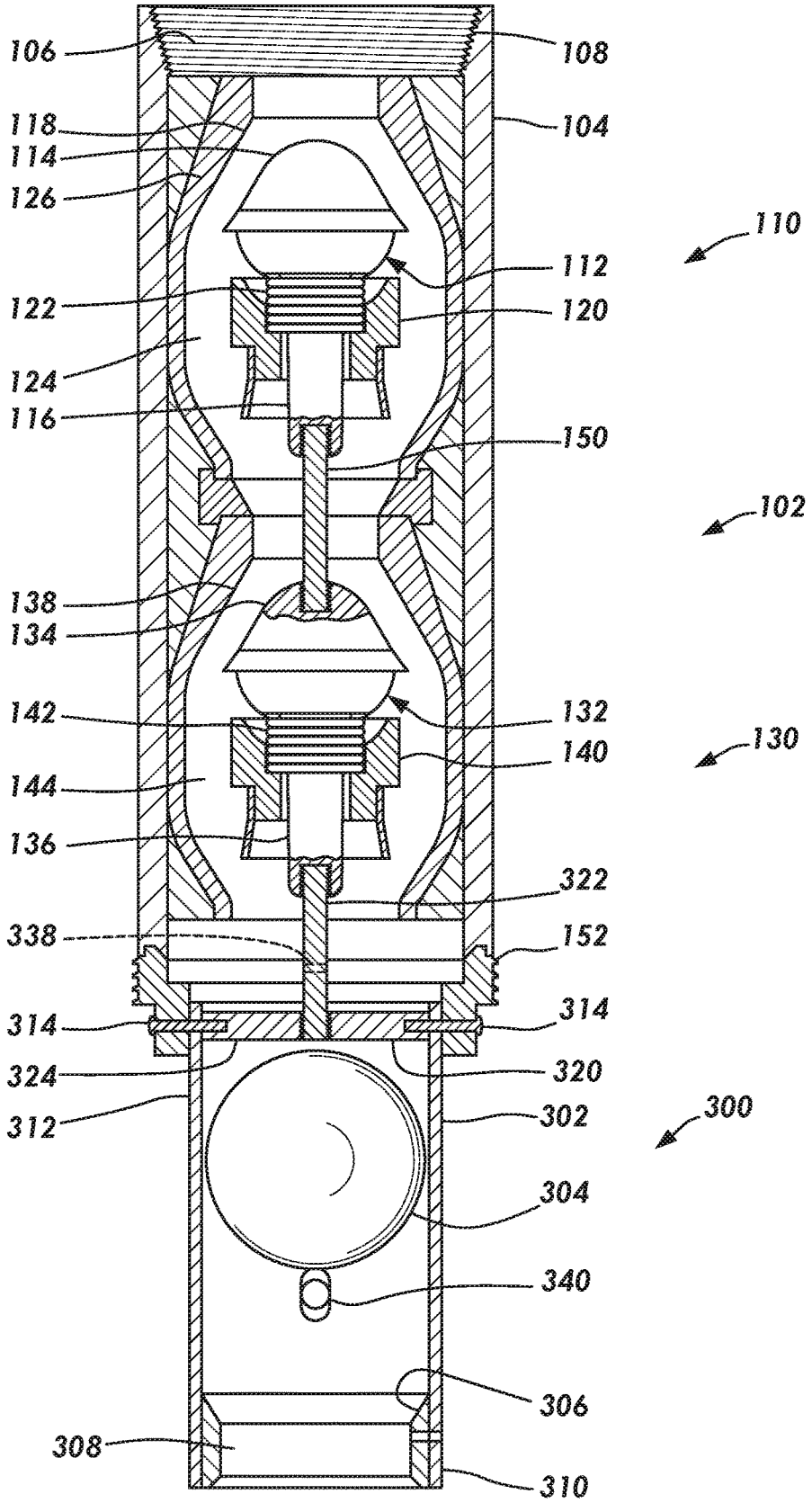
FIG. 1 is a cross-sectional elevational view of an exemplary embodiment of a convertible valve assembly in a bi-directional configuration according to aspects of the disclosure.
Figure 2:
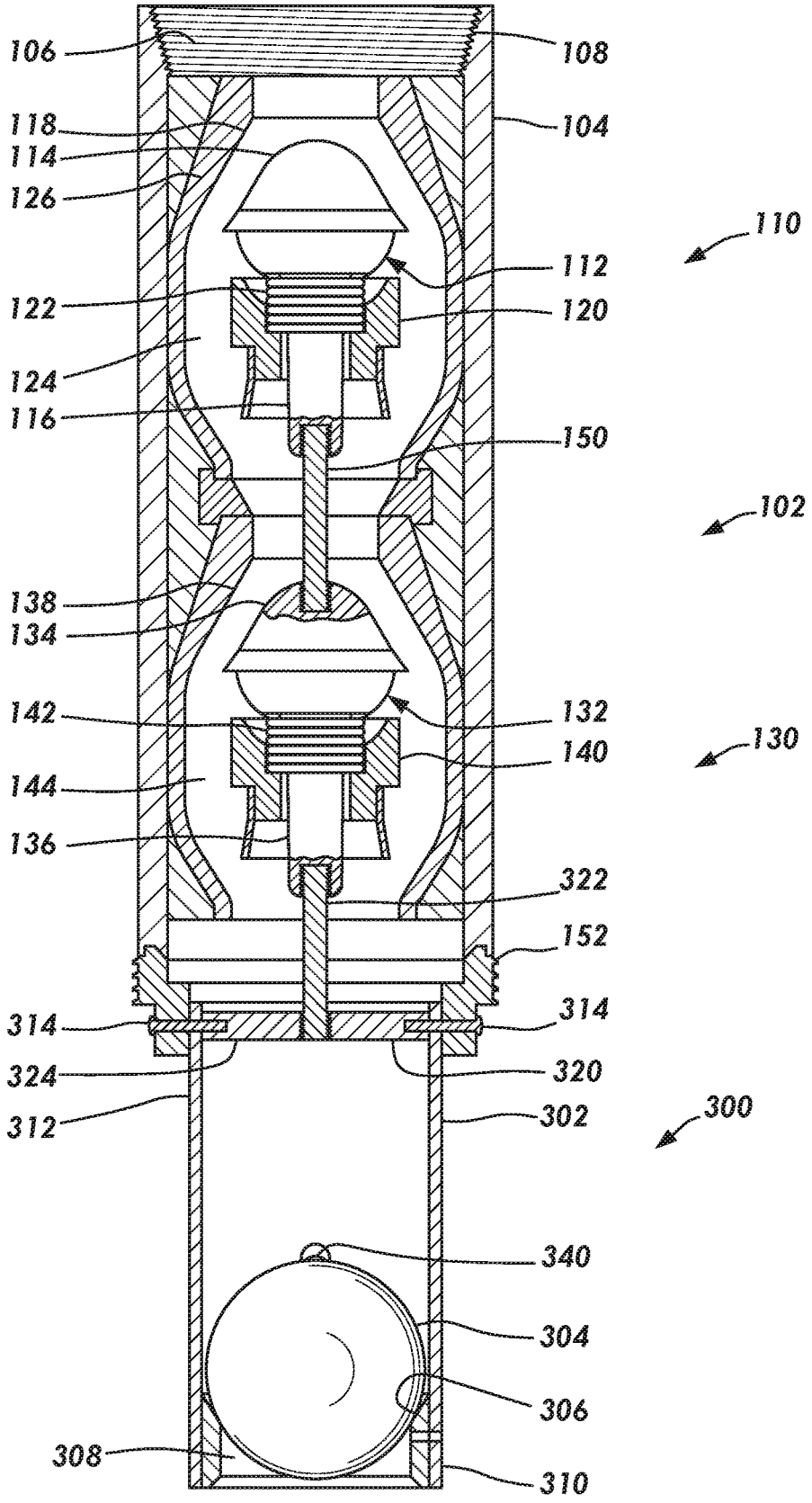
FIG. 2 is a cross-sectional elevational view of an exemplary embodiment of a convertible valve assembly in a bi-directional configuration with an occluding device seated according to aspects of the disclosure.
Figure 3:
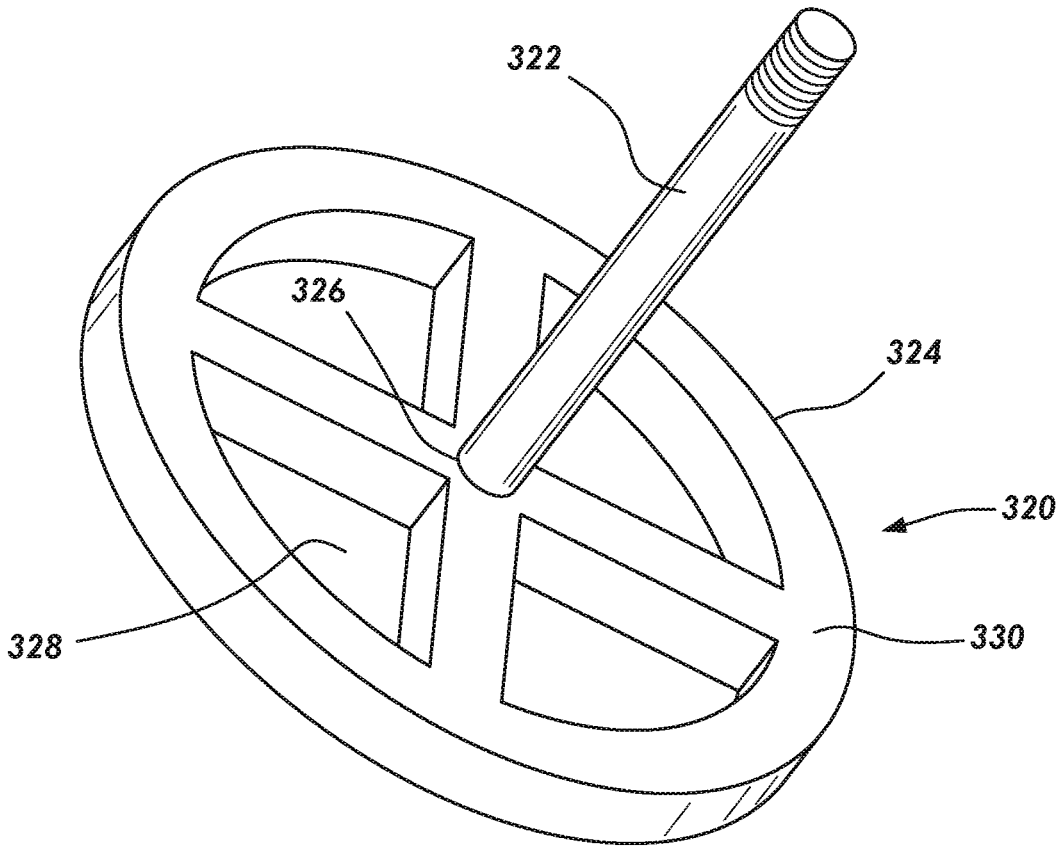
FIG. 3 is an orthogonal view of an exemplary retainer device according to aspects of the embodiment.
Figure 4:
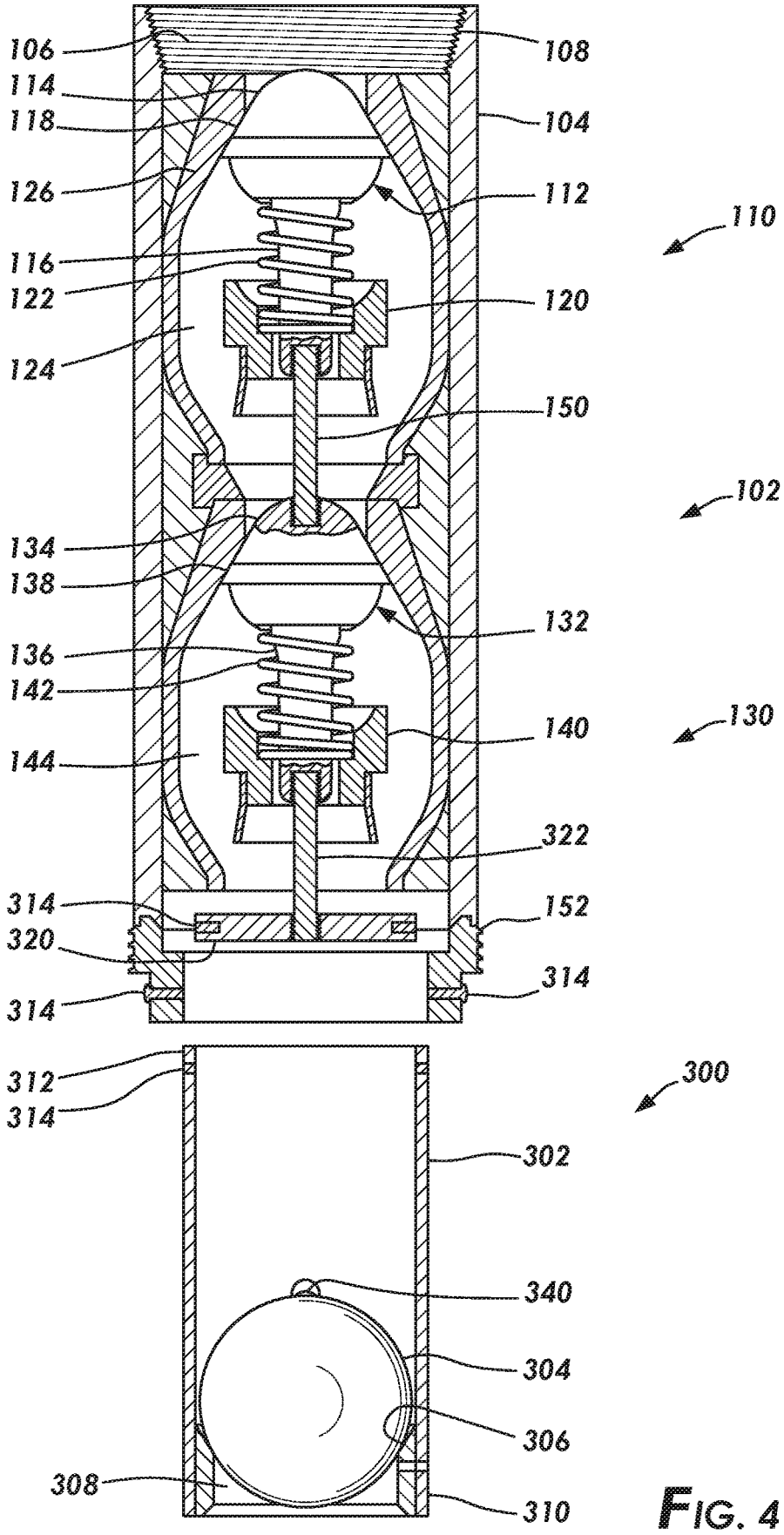
FIG. 4 is a cross-sectional elevational view of the exemplary embodiment of FIGS. 1-2 in a unidirectional valve configuration with the retainer assembly released according to aspects of the disclosure.
Figure 5:
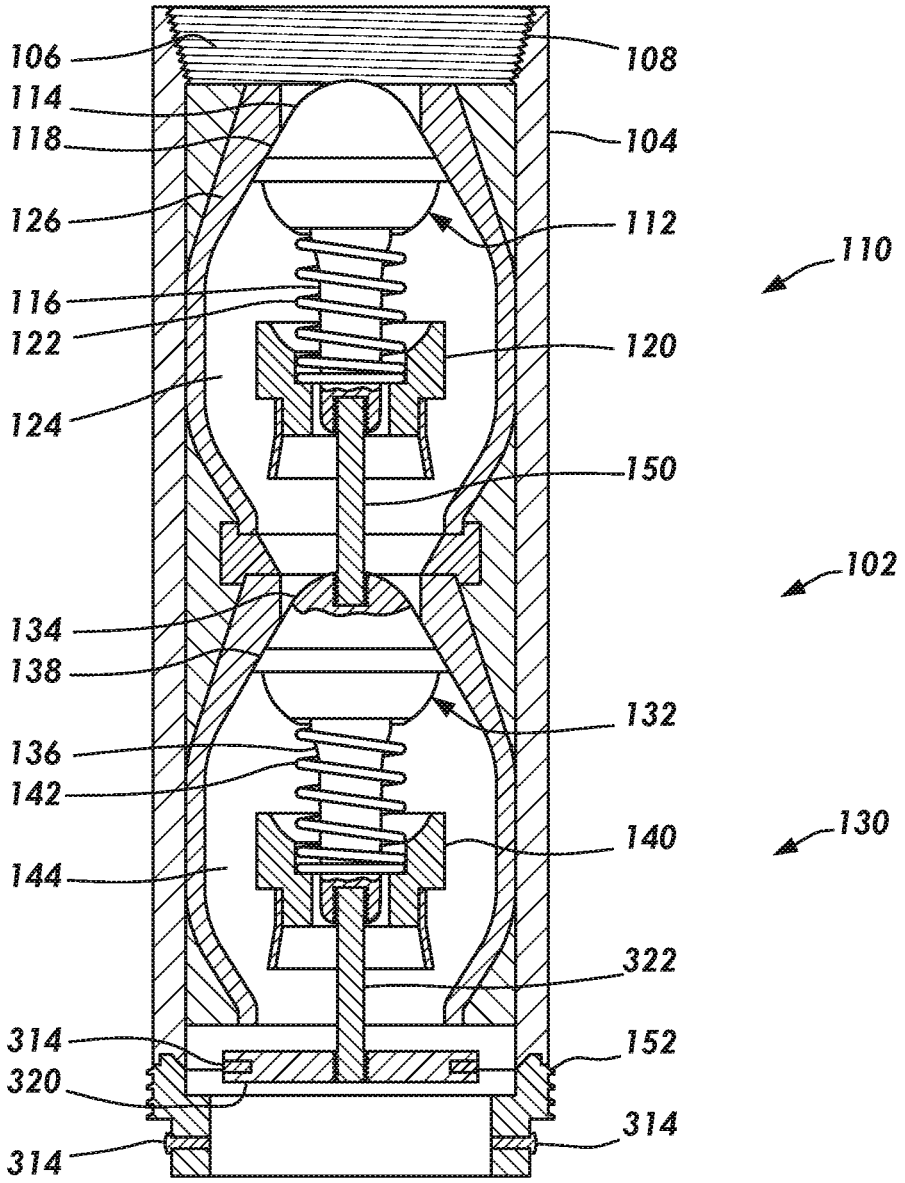
FIG. 5 is a cross-sectional elevational view of the exemplary embodiment of FIGS. 1-2 and FIG. 4 in a unidirectional valve configuration with the retainer assembly released and removed according to aspects of the disclosure.

FIG. 1 is a cross-sectional elevational view of an exemplary embodiment of a convertible valve assembly in a bi-directional configuration. FIG. 2 is a cross-sectional elevational view of an exemplary embodiment of a convertible valve assembly in a bi-directional configuration with an occluding device seated on a seat within the retaining assembly. FIG. 3 is an orthogonal view of an exemplary retainer device. FIG. 4 is a cross-sectional elevational view of the exemplary embodiment of FIGS. 1-2 in a unidirectional valve configuration with the retainer assembly released. FIG. 5 is a cross-sectional elevational view of the exemplary embodiment of FIGS. 1-2 and 4 in a unidirectional valve configuration with the retainer assembly released and removed.

FIG. 1 shows an exemplary convertible valve assembly 100 according to aspects of the disclosure including a valve assembly 102 and a conversion assembly 200. The assembly 100 is seen in an bi-directional configuration in FIG. 1, wherein the valve assembly, and both the upper and lower valves 110 and 130, are in open positions allowing bi-directional fluid flow through the assembly. The assembly is maintained in the bi-directional configuration during run-in to the wellbore.

The valve assembly 102 has a housing 104 defining a generally longitudinal flow bore 106 therethrough. The upper end of the housing 104 includes a connection 108 for connecting the housing to a tubular as part of a casing, liner or work string, for example. The connection can be a threaded connection or other connection as known in the art.

The valve assembly 102 includes an upper valve 110 and a lower valve 130, both positioned in the housing 104, arranged in series. The upper and lower valves 110 and 130 are plunger type valves. Plunger type valves offer improved reliability over flapper valves, for example, which tend to be used in large bore autofill valve applications. Further, plunger type valves are, for the same performance, smaller and lighter than the flapper type valves typically used in such applications. This leads to reduced drill out times and less debris when the valve assemblies are drilled out after use.

The upper valve 110 has an upper valve element 112 with an upper valve head 114 and an upper valve stem 116. An upper valve seat 118 is defined in the housing 104. The seat can be defined on the housing wall or on an insert 126 in the housing 104, as shown. The upper valve head 114 of the upper valve element 112 cooperates with the upper valve seat 118. The upper valve element is moveable between a closed position, wherein the upper valve head 114 sealingly engages the upper seat 118, and an open position wherein the upper valve head is spaced apart from the upper seat. An upper valve stem guide 120 guides reciprocating movement of the upper valve stem 116, provides a shoulder for the biasing mechanism 122, and limits downward movement of the upper valve element 112. The biasing mechanism 122, shown as a spring, biases the upper valve element towards the closed position. When in the open position, a flow path 124 allows fluid flow past the upper valve 110.

The lower valve 130 has a lower valve element 132 with a lower valve head 134 and a lower valve stem 136. A lower valve seat 138 is defined in the housing 104. The seat can be defined on the housing wall or on an insert 126 in the housing 104, as shown. The lower valve head 134 of the lower valve element 132 cooperates with the lower valve seat 138. The lower valve element is moveable between a closed position, wherein the lower valve head 134 sealingly engages the lower seat 138, and an open position wherein the lower valve head is spaced apart from the lower seat. A lower valve stem guide 140 guides reciprocating movement of the lower valve stem 136, provides a shoulder for the biasing mechanism 142, and limits downward movement of the lower valve element 132. The biasing mechanism 142, shown as a spring, biases the lower valve element towards the closed position. When in the open position, a flow path 144 allows fluid flow past the lower valve 130. Since the upper and lower valve elements are tied together, in some embodiments the biasing assembly acts against only one valve element.

The exemplary insert 126 provides a housing and seats for the upper and lower valve heads 114 and 134, respectively, can be fixedly attached to the valve housing 104 or rotationally attached, allowing for rotation of the valve assembly about a longitudinal axis. A fixed attachment tends to make drilling out of the valve assembly less problematic.

The upper and lower valve elements 112 and 132, respectively, are connected together, such as by a connection element 150, such that the valve elements move in unison. That is, when one valve is moved to its closed position, both valves are moved to their closed positions, as seen in FIG. 4. Similarly, moving one valve to the open position also operates to move the other valve to its open position, as seen in FIG. 1. In some embodiments, the connection element 150 is a rod threadedly connected to the upper valve stem 116 and lower valve head 134. Persons of skill will recognize equivalent connection elements, methods of attachment, and points of attachment.

The lower end 152 of the valve assembly 102 is attached to a retainer assembly 300. The retainer assembly 300, in some embodiments, can generally be considered to be a caged ball, shear tube releasably attached to the valve assembly 102. Other embodiments are disclosed herein as well. The retainer assembly has a housing 302 defining a chamber 303, inside of which is a free-floating occluding device 304. It is understood that the occluding device can be of various shape and size. In the exemplary embodiment shown, the occluding device is a ball. The occluding device 304 cooperates with a seat 306 defined in the retainer housing 302. The occluding device 304, in response to downward fluid flow through the housing, seats on seat 306. The seat 306 defines a bore 308 therethrough allowing fluid flow out the lower end 310 of the housing 102 when the occluding device 304 is unseated.

In some embodiments, the retainer assembly 300 is releasably attached to the valve assembly 102. In the embodiment shown, the upper end 312 of the retainer housing 302 is releasably attached to the lower end 152 of the valve housing 104. The releasable attachment can be any known in the art, such as shear pins 314, shear ring, snap ring, etc. The shear pins 314 extend through the valve housing lower end 152 and the retainer housing upper end 312.

A retainer device 320 is operable to maintain the valve assembly 102, at both upper valve 110 and lower valve 130, in the open, bi-directional configuration, and to release the valve assembly 102 to a unidirectional configuration, wherein the valve assembly, at both upper and lower valves 110 and 130, are in a biased closed position. To that end, the retainer device is releasably attached to, for example, the lower valve element 132.

An exemplary retainer device 320 is in seen orthogonal view in FIG. 3. The device 320 has a retainer rod 322 connected to the lower valve stem 136, such as by a threaded connection. The retainer rod 322 is further connected to a retainer device body 324, such as at threaded connection 326. The retainer device body 324 is releasably connected to the retainer housing 302, such as at a releasable connection. Here, the releasable connection is at shear pins 314, although the connection can be shear pins, a shear ring, a snap ring or the like, as is known in the art. The retainer body 324 has an exemplary circumferential element 330 which abuts or is in proximity to the wall of the retainer housing 302 and is releasably connected thereto by the shear pins 314 which cooperate with shear pin holes 315 defined in the circumferential element 330. The retainer device 320 allows fluid flow past the retainer device 320, whether the valve assembly is in the bi-directional or unidirectional configuration. In some embodiments, the retainer device defines flow paths, such as paths 328, to allow such flow.

The retainer device 320 performs two primary functions: maintaining the valve assembly in the bi-directional configuration during run-in; and releasing the valve assembly to a unidirectional configuration, wherein the valve assembly is biased closed for use in downhole operations, such as cementing for example.

To release the valve assembly, the retainer device 320 breaks a connection to the valve assembly 102 or the valve assembly housing 104. In the exemplary arrangement seen in FIGS. 1-5, the retainer device 320 breaks a connection to the valve assembly housing 104 and the retainer housing 302 at shear pins 314. When the pins 314 shear, the retainer housing 302 is released from the valve assembly housing 104. The retainer device 320 is free to move with respect to the valve assembly housing 104. The device 320, in response to the biasing mechanisms 122 and 142, is moved upwards along with the upper and lower valve elements 112 and 132. The retainer device body 320 continues to allow flow through its flow paths 328 in its released position, seen in FIGS. 4-5.

It is understood that the retainer device 320 can be designed to release at other points and still perform the same functions. In the embodiments seen in FIGS. 1-5, the release mechanism is a plurality of shear pins 314 which extend through the valve housing 104, the retainer housing 302 and some portion of the retainer device 320, here the circumferential element 330 of the device body 324. In the embodiment shown, the valve housing 104, at its lower end 152, is radially larger than the upper end 312 of the retainer housing 302, such that the upper end 312 of the retainer housing 302 is positioned within the valve housing lower end 104. The retainer device body 320 is pinned to the retainer housing 302 and valve assembly housing 104 but is adjacent only the retainer housing 302. Those of skill in the art will recognize that the lower end 152 of the valve housing 104 can be positioned within a radially larger the upper end 312 of the retainer housing 302, with the shear pins extending through the upper end 312 of the retainer housing 302, the lower end 152 of the valve housing 104 and into the retainer device 320.

Further, those of skill in the art will recognize that the retainer device 320 itself can define a release mechanism. That is, the device can be designed to release or shear at a preselected location on the device. For example, the retainer device 320 can define a release mechanism on the retainer rod 322, such that the rod 322 shears to release the valve assembly from its retained position, with the retainer body 320 fixedly attached to the retainer housing 302. In such an embodiment, the retainer housing 302 is releasably attached to the valve housing 104 by a separate release mechanism. Those of skill in the art will recognize that the retainer device 320 can take a different shape and size than the exemplary embodiment shown.

In the embodiment seen in the figures, the retainer device 320 also performs the function of maintaining the occluding device 304 in the retainer housing 302. That is, during run-in, fluid flow upwards through the assemblies will tend to force the occluding device upwards towards the upper end 312 of the retainer housing 302. The occluding device 304 is prevented from movement into the valve assembly housing 104 by the retainer body 324. Those of skill in art will recognize that a separate obstruction can be employed to control and limit upward movement of the occluding device, such as a pin extending across the housing.

In the exemplary embodiment seen in the figures, the retainer housing 302 defines one or more radial flow ports 340 allowing fluid flow downward through the retainer assembly even when the occluding device 304 is seated on seat 306. The flow ports 340 allow downward fluid flow up to a preselected flow rate without building sufficient pressure above the occluding device to cause the release mechanism to actuate. Flow through the ports 340 exits the housing 302 into a wellbore annulus defined between the housing and the wellbore. For example, the ports 340 can be designed to allow a relatively low flow rate of around 1.5 to 3.0 barrels per minute without actuating the retaining mechanism. When the pump rate is increased to a preselected rate, such as 4.0 barrels per minute, pressure in the retainer housing 302 above the occluding device 304 rises to a preselected pressure at which point the occluding device 304, pushing downward on the seat 306 shears the shear pins 314, thereby releasing the retainer housing 302 from the valve assembly housing 104 and the retainer device 320 from the retainer housing 302 and the valve assembly housing 104. In another embodiment, the ports 340 are designed to allow a relatively high flow rate of around 3-4 barrels per minute without actuating the retaining mechanism. When the pump rate is increased above that rate, such as to 5-8 barrels per minute, pressure in the retainer housing 302 above the occluding device 304 rises to a preselected pressure at which point the occluding device 304, pushing downward on the seat 306 and the retainer housing 302, shears the shear pins 314.

In use, the valve assembly 102 and retainer assembly 300 are attached to a casing or other tubular string at a well site. The valve and retainer assemblies are run downhole with the valve assembly in the bi-directional configuration, with both the upper and lower valves 110 and 130 in the open position allowing fluid flow during run-in, as seen in FIG. 1. During run-in the valve assembly 102 is maintained in the bi-directional configuration by the retainer assembly 300. More specifically, the retainer device 320 is connected to the lower valve element 132, holding the connected upper and lower valve elements 112 and 132 down in the open positions. During run-in, fluid flows upwardly through the assembly housings 302 and 104, past the open valves 110 and 130. The occluding device 304 is limited in its upward movement, relative to the assemblies, by, for example, the retainer body 324.

Once the tools are in position in the wellbore, additional operations may be performed. For example, various fluids may be pumped down the casing string, through the valve assembly and the retainer assembly as seen in FIG. 2. Downward fluid flow pushes the occluding device 304 into contact with the seat 306, blocking fluid flow past the seat. (In some embodiments, the seat 306 defines bypasses for allowing some fluid flow, for example, up to a preselected flow rate, without building sufficient pressure to release the release mechanism.)

In the embodiment shown, the radial flow ports 340 allow fluid flow downward through the valve assembly 102, into the retainer housing 302 and out the flow ports 340. The fluid flows through bore 106, open upper valve 110 at flow path 124, open lower valve 130 at flow path 144, and out the valve assembly at lower end 152. Flow continues past retainer device 320 via flow paths 328 and into retainer housing 302. Here, flow passes through the bore 308 in seat 306 until the occluding device 304 seats. In embodiments allowing flow at a preselected flow rate, bypassing the seated occluding device, flow will continue through, for example, radial ports 340 and into the wellbore. Flow through such ports can be useful for flowing debris, such as cuttings or formation rock from a weak formation, out of the casing string, for example.

When it is desired to convert the convertible valve assembly to a unidirectional valve assembly, fluid is pumped down the casing string, through the open valves 110 and 130 and into the retainer housing 302. Downward flow seats the occluding device 304 on seat 306. Fluid flows out flow ports 340, where present, into the wellbore annulus. Fluid flow may continue through ports 340 up to a preselected rate without actuating the retaining assembly. Pressure is built up in the retainer housing 302 above the occluding device 304 to a pressure preselected to actuate the retainer assembly.

In the embodiment shown, a preselected pressure actuates the release mechanism, namely, shear pins 314. The shear pins 314 shear, releasing the retainer housing 302 from the valve assembly housing 104 and releasing the retainer device 320 from the valve assembly housing 104 and retainer housing 302.

In the embodiment shown, the retainer device 320 separates from the retainer housing 302 and the valve assembly housing 104 at shear pins 314. This releases the valve assembly to the unidirectional configuration seen in FIG. 4. The retainer device 320 no longer holds the lower valve element 132, and in turn the upper valve element 112, in the open position. The biasing mechanisms 122 and 144 act against the valve elements 112 and 132, respectively, moving the upper and lower valves 110 and 130, respectively, to the closed positions. The valve assembly is now converted from a bi-directional configuration to a unidirectional configuration.

The retainer assembly 300, in main part, drops from the end of the casing string into the wellbore (or, if present, shoe assembly), as seen in FIG. 5. More specifically, the retainer housing 302 and occluding device 304 are dropped into the wellbore. The retainer device 320 can be retained, connected to the valve assembly, or can be dropped, in whole or part, along with the remainder of the retaining assembly into the wellbore depending on the position of the releasable connections in the embodiment.

In some embodiments, the retainer device 320 is released at other points than the shear pins 314. The retainer device 320 itself can define a release mechanism, in which case the retainer device 320 releases or shears at a preselected location on the device. For example, the retainer device 320 can shear at a point on the retainer rod 322, such that the rod 322 releases from the lower valve element 132. In such a case, the remainder of the retaining device 320 falls into the wellbore.

In the unidirectional configuration, as seen in FIG. 5, fluids can be flowed down the casing string against the biased, closed upper valve 110. Once fluid pressure above the valve assembly exceeds the forces exerted by the biasing mechanisms 122 and 144, the upper and lower valve elements 112 and 132 open in unison, allowing fluid flow therethrough. For example, cement can be flowed from the surface, through the casing string, forcing open the upper and lower valves, out the lower end of the valve assembly housing 104 and into the wellbore. Flow back from the wellbore into the valve assembly is prevented by the one-way valves 110 and 130.

When desired, the valve assembly 102 can be drilled out, clearing the casing string of restrictions.

Those of skill in the art will recognize that the retaining assembly, or parts thereof, can be positioned above the valve assembly. For example, the retaining housing can be positioned above the valve assembly. The occluding object can be flowed down from the surface or caged within the housing. Pressure above the occluding device causes movement of the seat, shearing of a shear mechanism which releases the retainer device 320 from, in this case, the upper valve element 112, thereby releasing the valve assembly to move to the unidirectional configuration.

The embodiments disclosed above are illustrative only, as the present disclosure may be modified and practiced in different but equivalent manners apparent to those skilled in the art having the benefit of the teachings herein. It is, therefore, evident that the particular illustrative embodiments disclosed above may be altered or modified and all such variations are considered within the scope of the present disclosure. The various elements or steps according to the disclosed elements or steps can be combined advantageously or practiced together in various combinations or sub-combinations of elements or sequences of steps to increase the efficiency and benefits that can be obtained from the disclosure. It will be appreciated that one or more of the above embodiments may be combined with one or more of the other embodiments, unless explicitly stated otherwise. Furthermore, no limitations are intended to the details of construction, composition, design, or steps herein shown, other than as described in the claims.

It is claimed:

1. A downhole convertible valve tool for use in a subterranean wellbore, the downhole convertible valve tool comprising:

a convertible valve assembly for use in controlling fluid flow through a downhole tubular positioned in a subterranean wellbore, the convertible valve assembly having a valve housing defining a throughbore;

a valve assembly for controlling fluid flow through the throughbore, the valve assembly having:

an upper plunger valve with an upper valve element;

a lower plunger valve with a lower valve element;

the upper valve element and lower valve element connected such that the valve elements move in unison, the valve assembly having an open position wherein both the upper and lower valve elements allow fluid flow through the valve assembly, and a closed position wherein both the upper and lower valve elements are positioned to prevent fluid flow through the valve assembly; and a retainer device maintaining the valve assembly in the open position for allowing bi-directional fluid flow through the throughbore, and the retainer device selectively releasable to allow the valve assembly to move to the closed position wherein the upper and lower valves are biased toward the closed position by a biasing mechanism, and allow unidirectional fluid flow through the throughbore when fluid pressure exceeds the force of the biasing mechanism.

2. The convertible valve assembly of claim 1, wherein the retainer device is connected to the lower valve element and selectively connected to the valve housing.

3. The convertible valve assembly of claim 1, further comprising a retainer assembly having a retainer housing with an occluding device positioned therein, the occluding device movable in response to fluid flow through the retainer housing to move to a seat defined in the housing.

4. The convertible valve assembly of claim 3, wherein the retainer housing is selectively releasable from the valve housing.

5. The convertible valve assembly of claim 4, wherein the retainer device is connected to the retainer housing, the retainer device further comprising a release mechanism for releasing the retainer device from the lower valve element.

6. The convertible valve assembly of claim 3, wherein the retainer device is releasably connected to the valve housing or retainer housing.

7. The convertible valve assembly of claim 3, wherein the retainer housing further comprises at least one control port through a wall of the retainer housing, the at least one control port sized to build hydraulic pressure within the retainer housing sufficient to release the retainer housing from the valve housing in response to flowing fluid through the at least one control ports above a preselected flow rate.

8. The convertible valve assembly of claim 3, wherein the retainer device comprises a retainer rod connected to the lower valve element, a generally circumferential element connected to the retainer rod, the circumferential element releasably connected to the retainer housing, the retainer device defining flow paths therethrough.

9. A method of converting a fluid flow valve from a bi-directional valve to a unidirectional valve in a wellbore, the method comprising:

in a subterranean wellbore, maintaining a valve assembly in a bi-directional configuration with a retainer device wherein both an upper plunger valve and a lower plunger valve of the valve assembly are in an open position, the upper and lower plunger valves connected together such that the upper and lower plunger valves move in unison;

while the valve assembly is maintained in the bi-directional configuration, sequentially flowing fluid through the throughbore in an uphole and a downhole direction;

releasing the retainer device and moving the valve assembly to a unidirectional configuration in which the upper and lower plunger valves are biased to a closed position by a biasing mechanism and;

flowing fluid unidirectionally through the valve assembly when fluid pressure exceeds the force of the biasing mechanism.

10. The method of claim 9, further comprising selectively releasing the retainer device in response to flowing a fluid through the retaining assembly.

11. The method of claim 10, further comprising releasing a release mechanism selectively attaching the retainer device to the retainer housing or to a valve assembly housing of the valve assembly.

12. The method of claim 10, further comprising moving an occluding device onto a seat defined in the retainer housing, and in response thereto, increasing a pressure in the retainer housing uphole from the occluding device.

13. The method of claim 12, further comprising, in response to increasing the pressure, releasing the retainer device to move upwardly in the valve assembly.

14. The method of claim 12, further comprising increasing the pressure in the retainer housing to a pressure sufficient to actuate the release mechanism by flowing fluid through the retainer housing at or above a preselected flow rate.

15. The method of claim 12, further comprising releasing the retainer housing and occluding device from the valve assembly.

16. The method of claim 9, further comprising releasing the retainer device from attachment to the lower plunger valve.

17. The method of claim 9, further comprising, after moving the valve assembly to the unidirectional configuration, flowing fluid downward through the valve assembly, the fluid applying pressure to the upper plunger valve, the fluid pressure opening the upper and lower plunger valves in unison.

18. A convertible valve assembly for use in a downhole tool, the assembly comprising:

a valve assembly positioned in a downhole tool for use in a subterranean wellbore, the valve assembly having an upper and a lower plunger valve connected to one another such that both valves move in unison between open and closed positions;

a retainer assembly for maintaining the upper and lower valves in a bi-directional configuration, the retainer assembly selectively releasable to release the upper and lower valves to a unidirectional configuration wherein the valves are biased towards a closed position.

19. The convertible valve assembly of claim 18, the retainer assembly further comprising:

a retainer assembly housing releasably attached to the valve assembly; and a retainer device attached to the housing and releasably attached to one of the valves of the valve assembly.

20. The convertible valve assembly of claim 18, the retainer assembly further comprising: a retainer device attached to one of the valves of the valve assembly and releasably attached to a valve assembly housing.

* * * * *